US005483981A

United States Patent [19]

Vandromme et al.

[11] Patent Number: 5,483,981

[45] Date of Patent: Jan. 16, 1996

[54] CASING FOR COSMETIC PRODUCTS WITH REGULATED OPENING AND CORRESPONDING POWDER CASE

[75] Inventors: Michel Vandromme, Le Plessis-Brion; Charles Pileur, Noyon, both of France

[73] Assignee: Yves Saint Laurent Parfums (Societe Anonyme), Neuilly Sur Seine, France

[21] Appl. No.: 219,354

[22] Filed: Mar. 29, 1994

[30] Foreign Application Priority Data

Apr. 6, 1993 [FR] France ..... 93 04071

[51] Int. Cl.[6] ..... A45D 33/00

[52] U.S. Cl. ..... 132/315; 132/296; 220/335; 16/305; 16/306; 16/307

[58] Field of Search ..... 132/286, 293, 132/315; 206/823, 581; 220/335, 343, 264; 16/83, 85, 86, 305, 306, 307

[56] References Cited

U.S. PATENT DOCUMENTS

| | | | |
|---|---|---|---|
| 3,308,835 | 3/1967 | Silverberg | 132/83 |
| 3,628,217 | 12/1971 | Schraber | 16/190 |
| 4,365,385 | 12/1982 | Gotoh | 16/382 |
| 4,483,355 | 11/1984 | Yuhara | 132/83 |
| 4,715,298 | 12/1987 | Weickert et al. | 220/335 |
| 5,033,162 | 7/1991 | Jacob et al. | 16/306 |
| 5,037,231 | 8/1991 | Kitamura | 16/307 |

FOREIGN PATENT DOCUMENTS

| | | |
|---|---|---|
| 1182518 | 6/1959 | France . |
| 2669371 | 5/1992 | France . |
| 498304 | 5/1930 | Germany . |

*Primary Examiner*—John G. Weiss
*Attorney, Agent, or Firm*—Rothwell, Figg, Ernst & Kurz

[57] ABSTRACT

The invention relates to a casing including an enclosure with its cover having a hinge a spring for controlling the opening of the cover and a mechanism for cushioning the opening movement of the cover. The mechanism for cushioning the open movement includes at least one substantially resilient foam block and/or flexion spring disposed in the casing so as to act during the substantial portion of the opening travel of the cover whilst absorbing the energy imparted thereto for its opening.

10 Claims, 3 Drawing Sheets

CASING FOR COSMETIC PRODUCTS WITH REGULATED OPENING AND CORRESPONDING POWDER CASE

The invention relates to the field of casings for cosmetic, make-up, hygiene or care products and more particularly rouge or powder cases (or powder compacts) used in the field of cosmetics by women for powdering themselves or for example for colouring their cheekbones or eyelids, casings of this type further constituting actual articles of jewellery in certain instances.

Among the casings known more particularly in this field some are equipped with a cover which is articulated in rotation relative to the casing enclosure following a movement which is so-to-speak "cushioned" i.e. the opening speed of which has been adjusted such that it is neither too slow, so as not to inconvenience the user, nor too fast, such that the general elegance of the casing and the components it contains can be appreciated as can the graceful and elegant effect which is produced by handling the casing.

However, as far as the applicants are aware, speed adjustment means of this type have usually consisted hitherto of "oil-bath" systems incorporating a viscous liquid enclosed in a chamber, the viscosity of the fluid and the adherence (i.e. the friction effects) of the parts in question of the casing with respect to this fluid enabling the cover opening speed to be adjusted as desired.

Viscous fluid systems of this type (which can in particular consist of silicone) may prove to be unstable over time and vary as a function of atmospheric conditions. Furthermore, given that a fluid is involved, the risk of leakages is always to be feared. Finally, certain specialists consider that the use of a viscous fluid in individual instances entails difficulties with respect to industrial application, increases manufacturing costs and multiplies the handling operations to which each casing is subject for its manufacture.

Within this context the object of the invention is to propose a casing which does not have the above-mentioned potential disadvantages and enables the cover opening speed to be adjusted subtly irrespective of the handling frequency of the cover or of the casing and practically irrespective of the general conditions of use.

To this end, the casing according to the invention is characterised in that it comprises:

an enclosure and its cover;

a hinge for articulating the cover in rotation relative to the enclosure;

means for controlling the opening of this cover; and means for cushioning the opening movement of the cover, for adjusting (slowing down) its opening speed, these cushioning means comprising at least one substantially resiliently compressible means.

Thus in order to adjust the opening speed of the cover, it is no longer a given index of viscosity or coefficient of friction which is to be used but the nature which is compressible to a greater or lesser extent of a cushioning means which operates by resilient compression to recover its compressibility potential whenever the cover is closed again.

In practice, for increased ease of use and an optimum control effect for opening the cover, the invention further provides that said cushioning means act during practically the entire, or at least the essential part of the, opening travel of the cover whilst absorbing the energy imparted to the cover for its opening by its associated control means until this energy is substantially cancelled at the end of travel.

As cushioning means the invention recommends the use of a block of foam and more particularly a block of synthetic foam for example impregnated polyurethane or PVC of which the reliability and heat stability are known, of which the cost price is low and of which the ease both with which its shape can be adapted and with which it can be positioned or even replaced is great without any risk of fouling other parts of the casing.

As experience with hinge articulation systems, in particular those used in the field of the invention, has shown that the adjustment of the speed must be subtly graduated such that it meets the desired aim and is in practice substantially regular over the entire travel, a preferred embodiment of the invention provides that:

the cover opening means comprise a first spring to open this cover relatively quickly; and the cushioning means comprise:

a second spring which acts against the first spring substantially during a first part of the cover opening travel; and the above-mentioned foam block, acting substantially during a second, final part of said travel.

Thus, in a first part of the opening travel it is possible to use a relatively rigid spring in order to absorb the abrupt acceleration imparted to the cover by its first spring, the cushioning at the end of travel being provided by the foam block which takes over from the second spring whilst the opening energy has already clearly decreased, the foam block avoiding any rebound effect at the end of travel.

Advantageously, in order to encourage the desired effect, the foam block is disposed in the vicinity of the cover articulation hinge.

Still within the context of a preferred embodiment of the invention, the casing enclosure can contain a slider which is mounted therein so as to slide under the control of the movement of articulation in rotation of the cover, the slider containing at least one of said cushioning means, advantageously such that the second spring, which is compressed or extended as a function of the movement of the slider, bears against a fixed wall of the enclosure.

In this way the manner in which the opening of the cover is performed can be subtly adjusted with a high degree of reliability and satisfactory dynamic efficiency.

Further characteristics and advantages of the invention will become clear from the following description given with reference to the attached drawings which are given solely by way of non-limiting example and in which.

Figure 1:
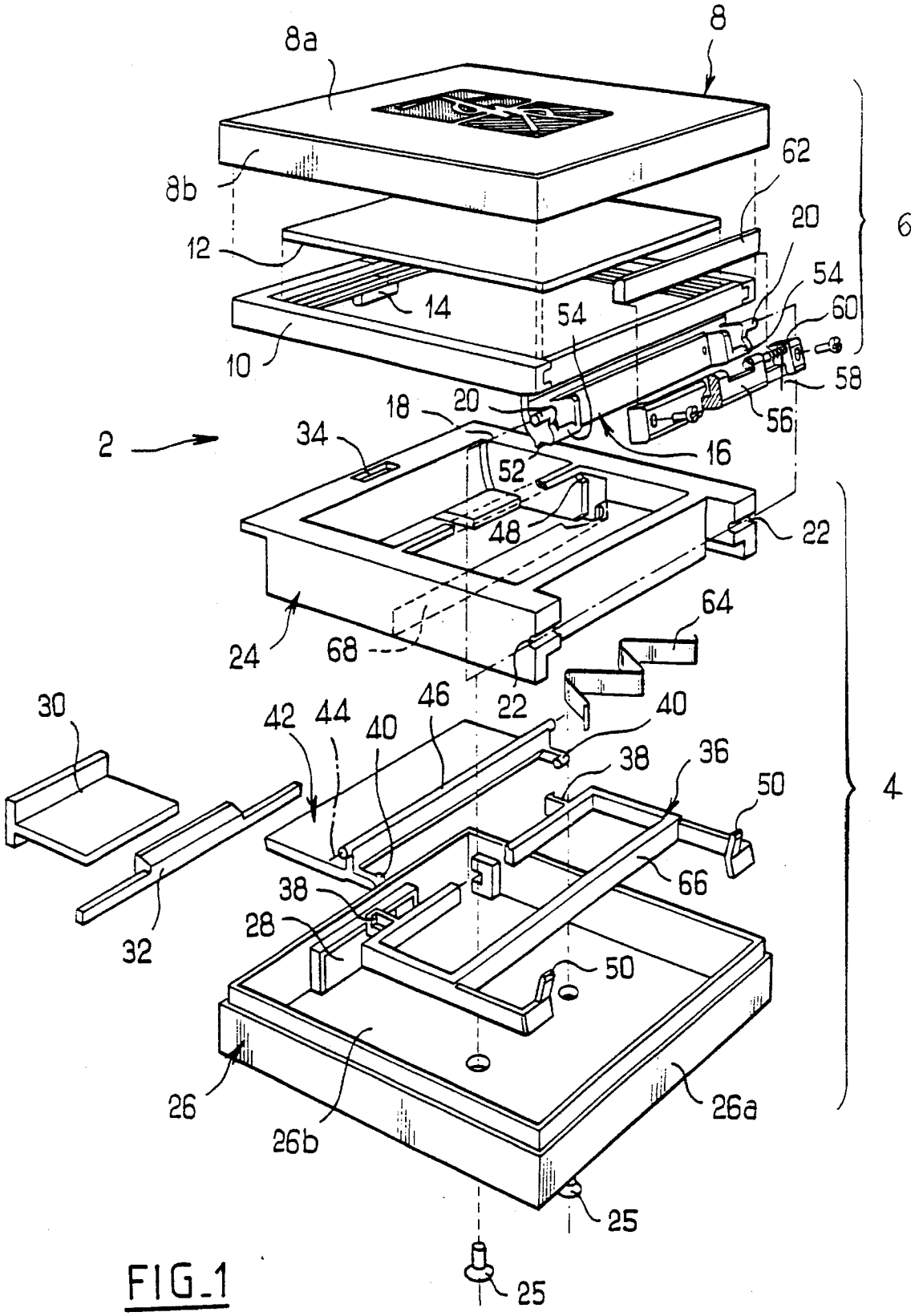
FIG. 1 is a perspective exploded view of a casing according to the invention in its entirety.

FIG. 1 firstly illustrates a casing 2 for powder and/or blusher substantially made of plastics material and comprising an enclosure 4 closed by a cover 6.

The cover substantially comprises a parallelepipedal block 8 with a base **8*a* and four peripheral side walls 8*b* inside which fits a frame 10 which holds a mirror 12 and is provided on one side (at the front) with a hook or notch 14 for locking the cover in the closed position and on the opposite side (at the rear) with a fallen wall extension defining a hinge area 16, with a transverse pin 18 having two lateral axial journals 20 adapted to swivel in bearings 22 of a part 24 connected to the enclosure for example by securing screws 25. This part 24, which is a fixed part, has a generally parallelepipedal shape which over all has the appearance of a frame which fits between the four side walls 26***a* of the parallelepipedal base block 26 at the bottom 26*b* of the casing 4.

At the front (marked AVT in FIG. 1) the case 26 has an opening 28 for the engagement therethrough of parts 30, 32 forming the pusher for locking the hook 14 through the opening 34 in the frame 24 when the cover is to be closed or for unlocking this hook when the enclosure is to be opened. Inside the part 24 a slider 36 is mounted so as to be movable in translation in the direction of the front or rear of the enclosure. At the front the slider 36 has two lugs 38 in which engage two journals 40 such that they rotate freely, which journals extend coaxially and substantially parallel to the hinge pin 18 and form part of a tilting portion 42 mounted so as to be articulated in rotation about a fixed pin 44 which is also parallel to the pin 18 via an upper axial bead 46 which can swivel in the bearings such as 48 carried by two opposite side walls of the part 24.

Figure 3:
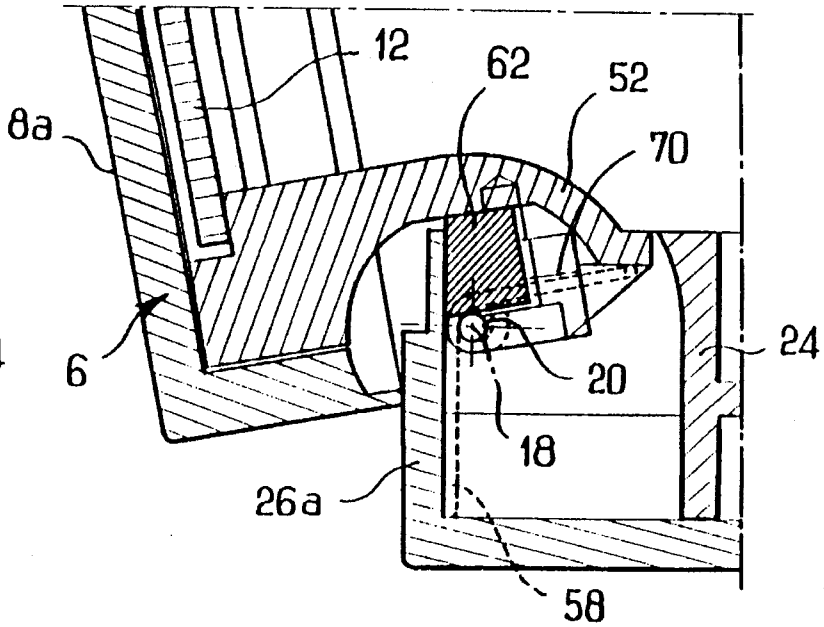
FIG. 3 shows the area of the casing of FIG. 2 with the foam block in place, the cover in this instance being in the fully open position.
Figure 5:
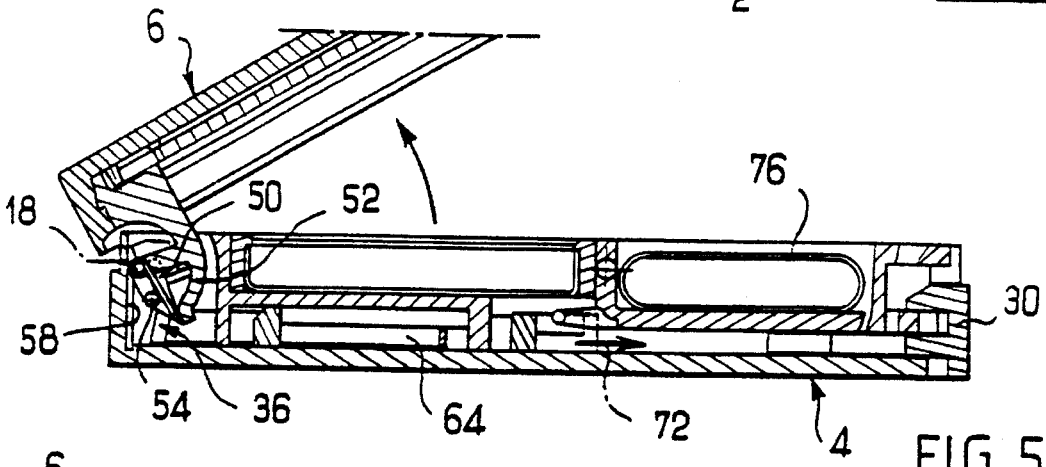

At the rear the slider 36 further has two side arms which are extended at a right angle parallel to the pin 18 by two partial wall portions each bearing an upper tongue 50, which are slightly inclined rearwards and which are each intended to engage between two areas of the part 16 forming a front guide finger 52 and a rear guide finger 54 respectively (cf. also FIGS. 3 and 5).

For the articulation in rotation of the cover, the part 16 here has, between these lateral guiding areas 52, 54 and its journals 20, a hollow in which engages a separate part 56 firstly bearing a first spring 58 wound about a shaft 60 carried by the part 56 and extending parallel to the pin 18 and secondly a cushioning foam block 62 which is for example made of polyvinylchloride with closed cells or acrylic impregnated polyurethane and the presence of which constitutes an important feature of the invention.

Figure 2:
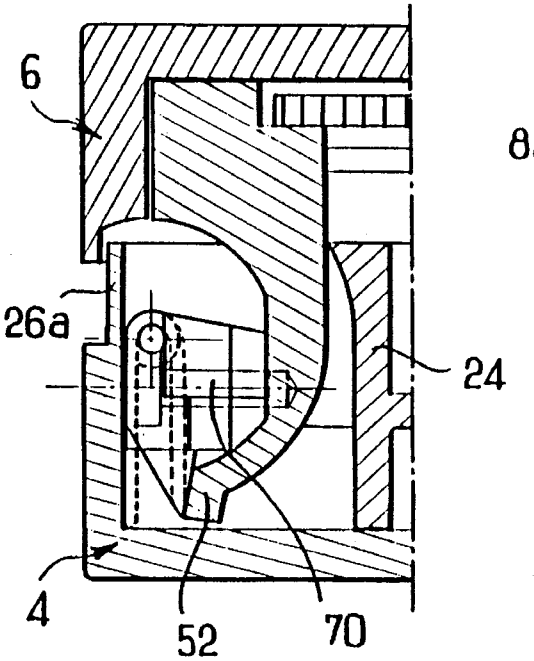
FIG. 2 shows in an enlarged detail view the preferred area for the installation of the cushioning foam block (the block itself is not shown)

With respect firstly to the spring 58 it will be noted that this is a torsion spring of the kickover type of which one of the two opposite end portions bears against the rear side wall 26*a* of the case 26 and the other bears against the corresponding finger 52 (cf. FIGS. 2, 3 and 5).

In the conventional manner, as soon as the hook 14 is released by manoeuvring the pusher 30, the torsion spring 58 thus positioned tends to extend, imparting its extension energy to the cover and thus causing the latter to open at a given speed as a function of the force of the spring.

The object of the invention is to alter this opening speed of the cover.

For this purpose, in this embodiment, two complementary cushioning means are used, i.e. the cushioning foam block 62 and a second spring (in this instance a flexion spring) 64 provided so as to be disposed inside the slider 36 bearing at the rear against the rear transverse wall 66 of the slider and at the front against a fixed transverse wall 68 forming part of the frame part 24.

Figure 4:
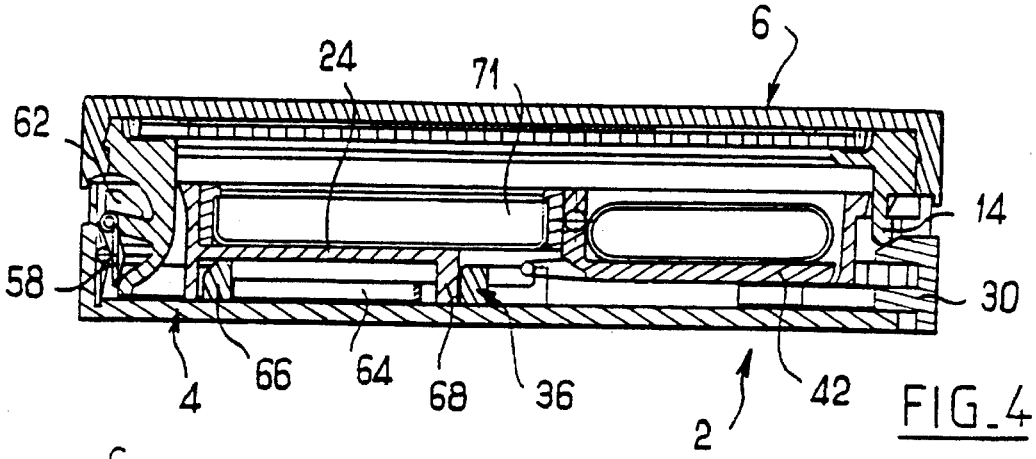
FIGS. 4 to 7 show in median longitudinal section the same casing in different states of opening or closure of its cover which are complete to a greater or lesser degree.

As illustrated in FIGS. 1, 4 to 7, the spring 64 can in particular consist of a metal blade folded substantially in a W-shape so as to be quite clearly rigid at the beginning of deformation in order, as soon as the notch 14 is released, to counter efficiently the expansion of the first spring 58 and thus to impart only a relatively slight acceleration to the cover at the beginning of travel, thus ensuring all the more an adjustment of its opening speed which will be able to have the desired regularity and desired relative slowness, the second part of the travel being taken over by the foam block 62 which, as FIG. 4 shows, is advantageously disposed in the immediate proximity of the area of the cover articulation hinge and thus of its pivot pin 18 so permitting, by compression, terminal cushioning at the end of travel without increasing the speed or final rebound, the foam block 62 in this instance being housed in the hollow of a separate cup-like part 70 (cf. FIGS. 2 and 3) secured to the cover in order to pivot therewith, between the fingers 52 and the top of the rear wall 26*a* of the casing against which the foam block is thus crushed at the end of the opening movement of the cover (cf. FIG. 3), the block resiliently recovering its original shape, like the spring 64, when the cover is closed again.

Reference will now be made to FIGS. 4 to 7 for a brief presentation of the opening and closing of the casing, it being specified that the blusher container housed in the part 24 is shown at 71.

In FIG. 4 first of all the casing is closed and the notch 14 is engaged. The spring 58 is compressed. Both the foam block 62 and the spring 64 are subject practically to no stress.

If pressure is applied to the pusher 30, the notch 14 is released and the spring 58 extends, imparting an acceleration in its opening direction to the cover (FIG. 5). The pivoting of the cover about its hinge pin 18 results in the simultaneous rotation of the bars 54 which themselves entrain the slider 36 in translation towards the front in the direction of the arrow 72, thus compressing the flexion spring 64 practically immediately, which almost instantaneously decelerates the opening speed of the cover by counter acting the effect of the spring 58. As from two thirds of the opening travel of the cover, for example, the cushioning effect of the spring 64 decreases and is replaced by that of the foam block 62 (cf. FIG. 6) of which the progressive compression maintains the opening speed substantially uniform until the end of travel where the stresses in one direction and in the other then substantially counterbalance one another.

Figure 6:
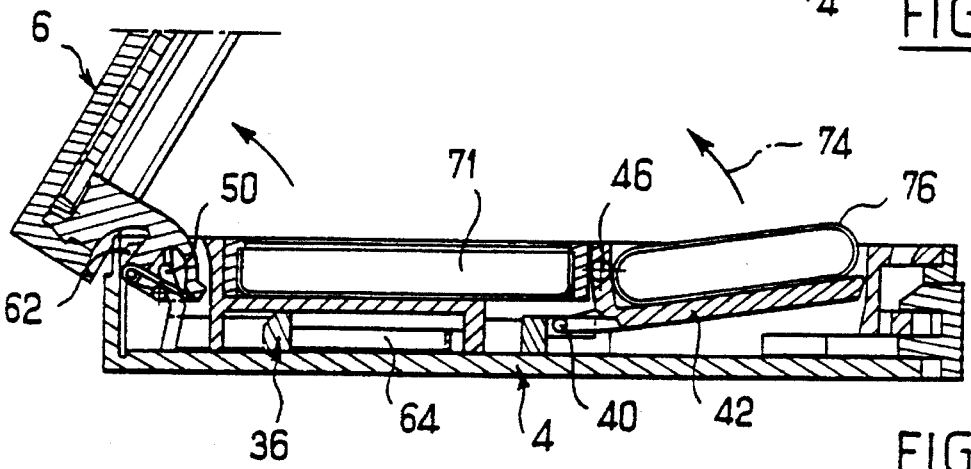
Figure 7:
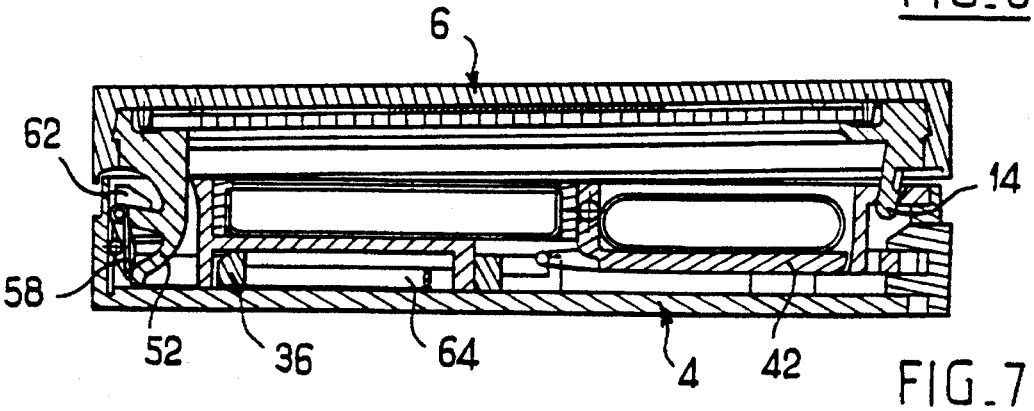

With respect to FIGS. 5 and 6 in particular it will be noted that the displacement of the slider 36 in the direction of the arrow 72 tends to cause the plate 42 to tilt upwards in the direction of the arrow 74, the plate 42 in this instance bearing a display device with a brush 76, under the thrust of the lugs 38.

In order to close the casing again, it is sufficient for the user to move the cover and the enclosure towards one another, thus releasing the foam block 62 then the spring 64 from their compression effect and simultaneously compressing the opening spring 58, by entraining the slider 36 rearwards by means of the fingers 52 controlling the cover, the slider evidently entraining the plate 42 which returns to its lower position in side the casing (FIG. 7), the manoeuvre terminating in the hooking of the notch 14.

Figure 8:
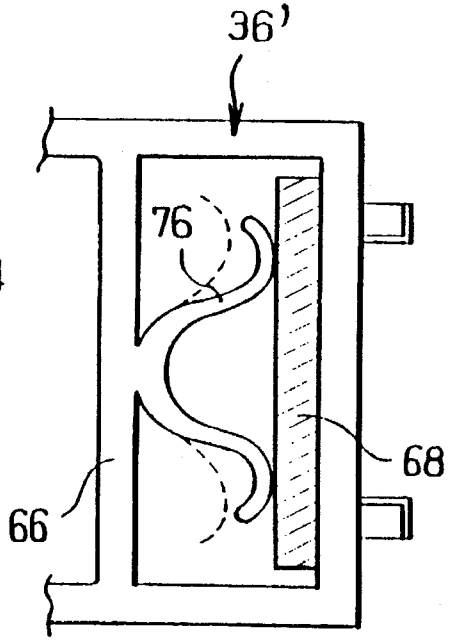
FIG. 8 shows in partial plan view avariant of the cushioning spring associated with the slider.

Referring now briefly to the illustration in FIG. 8 there is shown a variant of the sliding slider which in this instance is marked 36' and which differs from the slider 36 in that there is integrally moulded therewith a tongue forming a flexion spring 76 having two branches which substantially constitute a "Ω", which in its central portion is integral with the rear transverse wall 66 mentioned above such that at the beginning of the travel of the slider 36' the ends of the branches 76 bear against the wall 68 which is still present in the frame 24, thus counteracting the effect of the opening spring 58 (not illustrated here) which is still fitted.

We claim:

1. Casing for cosmetic, make-up, care or hygiene products, comprising:

an enclosure having a cover, the enclosure being suitable for containing said product;

a hinge coupling the enclosure and the cover for articulation in rotation of the cover relative to the enclosure;

the cover having a hook and the enclosure having parts for locking/unlocking the hook for retaining the cover in the closed position;

a first spring which is compressed in the closed position of the cover and exerts tension against the cover, and of which the extension of the first spring released by the unlocking of the hook is such that it causes the abrupt opening of the cover; and means for cushioning the opening movement of the cover in order to decelerate the abrupt opening of the cover by the first spring the cushioning means comprising at least one substantially resilient compressible element which can be compressed or extended as a function of the extension or compression of the first spring respectively.

2. Casing according to claim 1, characterised in that the cushioning means are disposed in the case to act progressively during the substantial portion of the opening travel of the cover by absorbing the energy imparted to the cover, for its opening, by the release of the first spring means until this energy is substantially cancelled at the end of travel.

3. Casing according to claim 1, characterised in that the compressible cushioning means is disposed inside a slider whilst being likewise in abutment against a fixed wall of the enclosure, the slider being mounted so as to slide in the enclosure under the control of the movement o articulation in rotation of the cover.

4. Casing according to claim 1, characterised in that the cushioning means comprise a compressible foam block.

5. Casing according to claim 4, characterised in that the foam block is disposed in the vicinity of the hinge for articulation of the cover.

6. Casing according to claim 3, characterised in that the cushioning means comprise:

a second spring acting against the first spring means substantially during a first portion of the opening travel of the cover; and a foam block which acts substantially during a second, final portion of the travel of the cover.

7. Casing according to claim 6, characterised in that the compressible cushioning means disposed in the slider consists of the second spring.

8. Casing according to claim 3, characterized in that the slider has a first end in the vicinity of the hinge for articulation of the cover and a second, opposite end which incorporates a pusher for rotating a pivoting part articulated about a pin fixed substantially parallel to the hinge pin and carried by the enclosure.

9. Casing according to claim 6, characterised in that the foam block is disposed closer to the articulation hinge of the cover than the second spring so as to take over therefrom after a first defined portion of the opening travel of the cover.

10. Casing according to claim 6, characterised in that the second spring is produced integrally, in a single part, with the slider and is substantially in the shape of a "Ω" in an unstressed state.

* * * * *